United States Patent [19]

Raswant

[11] Patent Number: 4,927,288

[45] Date of Patent: May 22, 1990

[54] ROAD TRAFFIC NETWORK

[76] Inventor: Subhash Raswant, 84-49 168th St., Apt. 1U, Jamaica, N.Y. 11432

[21] Appl. No.: 276,038

[22] Filed: Nov. 25, 1988

[51] Int. Cl.[5] ..... E01C 1/00
[52] U.S. Cl. ..... 404/1; 14/1
[58] Field of Search ..... 404/1; 14/1

[56] References Cited

U.S. PATENT DOCUMENTS

| | | | |
|---|---|---|---|
| Re. 15,333 | 4/1922 | Moe | 404/1 |
| 1,543,080 | 6/1925 | Graves | 404/1 |
| 1,629,787 | 5/1927 | Hackett | 404/1 |
| 1,682,679 | 8/1928 | Lawton | 404/1 |
| 2,941,454 | 6/1960 | Cedeno | 404/1 |
| 3,272,097 | 9/1966 | Gazis et al. | 404/1 |
| 3,399,379 | 8/1968 | Donnay | 404/1 |
| 3,533,062 | 10/1970 | Coffman | 404/1 |
| 3,847,496 | 11/1974 | Stankiewicz | 404/1 |
| 3,945,745 | 3/1976 | Chang | 404/1 |

FOREIGN PATENT DOCUMENTS

| | | | |
|---|---|---|---|
| 265349 | 10/1968 | Austria | 404/1 |
| 806019 | 6/1951 | Fed. Rep. of Germany | 404/1 |

OTHER PUBLICATIONS

Ridley, Triangular Hwy. Structure Urged for Nation Plan, 1941.

*Primary Examiner*—Jerome W. Massie
*Assistant Examiner*—Gay Ann Spahn
*Attorney, Agent, or Firm*—Henry R. Lerner; Andrew S. Langsam

[57] ABSTRACT

A road traffic network wherein the fundamental "building block" is an endless loop of one way traffic flow, a second endless loop of one-way traffic flow completely surrounded by the first endless loop and having traffic flow opposite in direction to the traffic flow direction of the first loop and an interconnecting traffic flow roadway extending between the two loops. The interconnecting roadway merges the traffic seeking to transfer between the two loops such that no vehicle crossovers or intersections are encountered. A road traffic network can be made from a plurality of interconnected "building blocks" or traffic flow systems, each such system being interconnected with either a single two-way roadway or two one-way roadways which, again, allow vehicle transfers between portions of the systems without crossovers or intersections. Intraloop roadways are also provided such that a vehicle need not travel over the entirety of the endless loop if it is desired for the vehicle to transfer between a portion of a first endless loop and a second portion of the same endless loop. The intraloop bypasses or crossovers serve to allow vehicles to take shorter trips then would be required if the vehicles are required to travel over the entirety of the endless loop in order to arrive at an loop interconnecting roadway for transfer to the other loops of the network. An entire traffic flow system, i.e., city-wide or larger, can be developed by building and interconnecting the basic building block or traffic flow systems into networks which, too, are interconnected with one another.

20 Claims, 2 Drawing Sheets

ROAD TRAFFIC NETWORK

BACKGROUND OF THE INVENTION

The present invention relates to a traffic road network for vehicular traffic which is intended to provide smooth flowing traffic without vehicle intersections, stop signs, stop lights, crossovers of traffic, etc. The traffic network is intended to eliminate the possibility of "grid-lock". More specifically, the present invention relates to providing a basic respectable traffic system or "building block" for a larger road traffic network. The basic system can be easily expanded depending upon the geographic need of the road network. The expanded network will eliminate all vehicular intersections, crossovers of traffic in front of oncoming traffic, stop signs, lights, etc. If the roadway intersections and vehicular crossovers are eliminated, (necessary, before the present invention, in order to make left turns and in view of perpendicular oriented streets) and, of course, grid-lock, too, is eliminated, then a smooth flowing roadway network results. The present invention relates to a roadway network which, while extremely simple to envision and immediately implement without requiring new highway building is far reaching in results. It eliminates roadway intersections, vehicular crossovers in making certain turns grid-lock, vehicle stops, attendant frustration at bumper to bumper traffic situations, etc. Today's urban metropolitan areas are extremely congested with vehicular traffic. Left turns across oncoming traffic is a major reason for traffic tie ups. Also because streets are generally perpendicular to other streets, providing intersections, traffic stop signs and stop lights are required. This, too, while providing for the safe flow of traffic, nevertheless, results in traffic tie-ups and, eventually, depending on traffic volume, bumper to bumper traffic. In New York City, for example, intersections of roads in the most busy areas of the city have been provided with special signs indicating that it is unlawful to "block the box". This is a direct reference to cars which move into the center of an intersection seeking either to go straight or turn and then when the light changes for the other direction of traffic, the vehicle cannot move out of the intersection. This results in a condition known as "grid-lock". It is highly desirable for traffic to move quickly and evenly through a metropolitan area and, to that extent, the reducing or complete elimination of traffic stoppings, road intersections, stop signs, and traffic lights is highly desirable. More specifically, it is well known that vehicles tend to travel quickly and simply on straight roadways and even when it is necessary for a vehicle to make a right-hand turn. That usually occurs with minimum delays.

The description of the invention of this application, by the way, relates to the American driving system i.e., where the driver tends to hug the right side of the road and oncoming traffic is on the relative left side of the road. This is in marked contrast to the English manner of driving wherein the vehicles hug the left side. Nevertheless, according to the American system of driving, therefore, right-hand turns by a vehicle approaching a perpendicular intersection are rather easily made since the car making the turn can simply merge into the oncoming traffic. Stated another way, a right-hand turn does not necessitate the crossing over of the vehicle with oncoming traffic. On the other hand, when a vehicle desires to make a left-hand turn into oncoming traffic, the vehicle must pull into the center of the lane and then wait until all oncoming traffic is cleared for making that left turn. All vehicles behind the left turning car, then, must await the completion of the left-hand turn before going either forward or making similar left turns. Clearly, the left-hand turn across oncoming traffic is a significant time delay and results in the not free flowing of vehicular traffic. Similarly, when two roads intersect with one another as, for example, at a perpendicular intersection, a vehicle on the cross street must await the change of the traffic light from red to green before proceeding. Here, too, waiting for the light to change so that you can cross the otherwise free flow of traffic results in significant time delay and, depending on vehicle volume, bumper to bumper traffic. Thus, eliminating left-hand turns in an American context across oncoming traffic and traffic intersections is a highly desirable object, for the purposes of clarification, an exactly inverse description would apply to a system based on the English model. The adoption of this system would result in more even and quicker vehicle flow. To do this, while ensuring safety of vehicle flow is a definite goal to be accomplished by traffic engineers.

*TIME* magazine, in the Sept. 12, 1988 issue, has a cover story on Grid-Lock. The article offers as possible solutions to the highway problem, the use of further mass transit, using a traffic flow display map in conjunction with adjusting the timing of traffic lights on freeway on ramps, etc. However the article further indicates that automobile use is a highly personal liberty by U.S. inhabitants and they are not likely to abandon their automobile for use of mass transit. Therefore, the present invention which allows individual automobile use on existing roads is highly desirable. The present invention, as will be more fully explained hereinafter, can be implemented onto existing roadways, without significant building expense and eliminates traffic crossings across oncoming traffic and intersections where one vehicle must wait its turn before proceeding across perpendicularly directed traffic..

The *NEW YORK TIMES*, on July 17, 1988, on page E7 published and article relating to grid-lock and its tremendous negative impact on metropolitan streets. There the suggestion is made to charge a higher New York City entry fee in order to limit the number of cars entering the midtown metropolitan central business district. Other proposals include higher fares during peak hours at the bridge and tunnel crossings or electronic road pricing which would require that every car be fitted with a transponder that could be monitored for monthly billing according to the car's contribution to overall traffic congestion. A driver would be charged extra for rush hour time in midtown, for example.

Again, those suggested solutions are not nearly as preferable as merely eliminating the traffic flow problem without necessary building expenses while preserving, to each driver, the right to travel whenever and wherever he wants, without additional cost. Eliminating the left-hand turns of vehicle across oncoming traffic and the necessity of traffic to await for red lights to turn green, prior to crossing in front of traffic going in a perpendicular direction is highly feasible. The present invention, as will be more fully explained hereinafter, eliminates, without major roadway construction, all crossing traffic and vehicle intersections, i.e. situations where traffic flow of vehicles cross in front of a second direction of traffic flow of vehicles.

Traffic management and regulation is a key concern of town and city planners as one component of the urban infrastructure. A larger overall issue, however, centers about a need for innovation with respect to the design of the conventional urban street pattern. The theoretical and professional underpinnings to the proposition notwithstanding, the following is a partial list of problems with respect to the prevailing pattern of urban transportation system as a whole.

1. Existing streets are, as presently and conventionally laid out, unsuited to motorized traffic because frequent road intersections are not only hazardous, but, in addition, they are also highly inefficient in terms of their effect on the smooth and constant flow of traffic.

2. Frequent traffic lights lead to frequent trip interruptions and when traffic builds up in volume, the natural result is gird-lock and unnecessary delays for the traveler.

3. Needless vehicle idling time at street intersections and traffic lights result in a colossal waste of time and energy and it also contributes to air pollution and environmental deterioration.

4. The overall cost for installing and operating traffic management devices in pre-existing street systems is presently considered to be exorbitant and economically unfeasible both for fixed equipment and, in addition, for operating and maintaining costs.

5. The potential for vehicular accidents at intersections is directly proportional to the size and complexity of the street crossing. Starting with only one (1) hazard point at a point of mere merging traffic, a T intersection has three (3) hazard points while sixteen (16) such hazard points can be the result of an ordinary two two-way street intersection, i.e., where traffic flows in both directions on each street.

Simply stated, therefore, the existing system for traffic management is highly inefficient in terms of economics, travel time, and environmental quality. It also poses a high risk for individual users in terms of personal safety and potential loss of property.

In a simple test of relative travel times conducted in suburban New York, it was observed that a five mile trip at about 40 miles per hour along an expressway took about 7 to 8 minutes. The same distance was traveled in almost 12 minutes on a parallel highway having normally spaced street intersections and traffic lights. The same five mile distance would take about 20 to 25 minutes on a Manhattan avenue, in view of the number of cross streets, traffic lights and vehicles seeking to make left-hand turns across oncoming traffic and merely due to cross-street intersections.

DESCRIPTION OF THE PRIOR ART

U.S. Pat. No. 3,533,062 relates to a traffic flow control system. The geographic grid sought to be covered by the traffic intersection and flow control system disclosed therein is devised into hexagonally shaped, multi-lane roadways having radiating multi-lane roadways extending outwardly from each corner of the hexagonal roadway. The present invention on the other hand, as will be explained more fully hereinafter is not limited to a specific configuration for the basic road network. No new major roadway construction is required. The "building block" for the overall traffic network of the present invention comprises a set of endless loops which can take any desired configuration as, for example, they can be rectangular, circular, oval, parallelogram, etc. In fact, each loop need not be the same general shape as one another. This provides real versatility at implementing the invention onto existing roadway systems. In addition, as can be seen in FIG. 1 of the '062 patent, traffic seeking to make a left-hand turn must necessarily cross over and in front of oncoming traffic from an adjacent roadway. This is the very problem of existing urban transportation which is sought to be avoided by the present invention. It seems inadequate to solve the needs of existing roadways in urban areas.

U.S. Pat. No. 1,543,080 also relates to a street traffic system. Here, however, each corner of a crossing intersection is provided with elevated rampways to facilitate traffic flow. Clearly, the construction and maintenance of such physical rampways is extremely expensive, space prohibitive and, in addition, according to FIG. 1, still does not solve the problem of making left-hand turns across and in front of oncoming traffic. The present invention, as will be more fully explained hereinafter, eliminates the construction of independent free-standing ramps and utilizes existing roadways in an infinite number of structural configurations. It eliminates traffic problems and can be instantly implements without huge construction costs.

U.S. Pat. No. 1,629,787 relates to a bridge approach. Basically, this reference utilizes a helically shaped ramp hidden within the interior of a building which serves to elevate vehicles from a first level up to the level of the bridge. This again requires the construction and maintenance of a separate structure and, also, entails the use of quite a bit of space. This, however, has little relevance to the traffic flow problem of street traffic in a suburban and urban metropolitan area.

U.S. Pat. No. 2,941,454 relates to a traffic intersection. According to this reference, a traffic circle is provided which utilizes both the outside and the inside lanes of the traffic circle and even allows traffic to exit from the traffic circle from the inside lanes. Here, again, this has little applicability to using existing roadways and providing for the smooth and even flow of traffic on these existing roads. Here, again, an expensive roadway rebuilding would be required to implement the traffic intersection shown in that reference whereas the present invention can be implemented without constructing new roadways, but rather by merely changing signs along the existing roadways.

U.S. Pat. No. Reissue 15,333 relates to an automobile "hotel" and again utilizes a double helix ramp arrangement of the type which has been frequently employed in parking garages. This, too, has little direct relevance to solving the traffic flow problems of street intersections in an urban environment.

U.S. Pat. No. 3,272,097 relates to a different traffic intersection and, again, requires the reconstruction of existing roadways and/or original building of new roadway intersections. Here, too, however, the device shown in that reference really relates to a traffic light apparatus which is employed at intersections to allow for vehicle crossovers so that a vehicle can go from one two-lane section surrounding a first city block to a second two-lane roadway surrounding the second city block. The lights traffic will cause certain traffic to periodically stop while crossover traffic is allowed to move forward. That, however, is directly contradictory to the present invention described herein which seeks to avoid traffic lights and the periodic stoppage of traffic but, rather, seeks to have traffic continuously moving along its roadway surfaces.

U.S. Pat. No. 3,399,379 also relates to a highway intersection system and, again, requires the rebuilding of existing highways with a diamond arrangement of highway intersections best seen in FIG. 1 of that patent. Similarly, U.S. Pat. No. 3,847,496 also relates to a traffic network for an urban settlement. According to its teachings, an urban area is encircled by a multi-lane, peripheral highway connected with outwardly radiating feeder roads by interchanges located at the corners of the rectangle. The interchanges have traffic circles enabling left turns and U-turns. This system also includes a set of three parallel tracks with the center track traveled by a continuously running express train and the two lateral endless tracks utilized by shuttle trains. This, again, requires extensive construction and the added expense of maintenance for an urban area and, yet still requires that roadway vehicle traffic, seeking to make a left-hand turn, stop and await the passage of oncoming traffic and, further, this system anticipates the frequent stopping of intersecting traffic at red colored traffic lights.

U.S. Pat. No. 1,682,679 again relates to a vehicle movement system utilizing a double helix for taking a vehicle from a first level to a second level. This, too, neither teaches no suggests the claimed invention.

German reference No. 806019 published June 11, 1951 relates to a street system comprising a single, continuously spirally directed roadway which at its center or nodal region reverses on itself to provide vehicles with the opportunity of travelling in the other direction. The continuous roadway has two-way direction of traffic flow and the adjacent portions of the continuous loop of roadway are, periodically, provided with one-way by-passes. One of the disadvantages of the system shown in the German reference is that it cannot be easily nor inexpensively implemented into existing roadways since it necessarily requires that the roadway continue as an endless spiral loop whereas the invention of the present traffic network can be easily implemented on existing roadways since the endless loops can take a large variety of shape configurations.

SUMMARY OF THE INVENTION

The present invention relates to a traffic roadway network which is comprised of a series of interconnected roadway "building blocks". Each "building block" of a traffic system comprises a pair of endless loops of one-way traffic These endless loops need take no particular shape configuration and, indeed, can be implemented on already existing roadway surfaces. The traffic network can, however, be implemented on new roadway installations and can be constructed to be shaped rectangularly, circularly, square, oval, parallelogram, etc. For the purpose of illustrating the present invention, however, the endless loops of the present invention are shown in irregular shape to further emphasize that they can be easily adapted to existing roadways and that new roadway surfaces need not be constructed to implement the present invention in existing urban areas. Each endless loop of roadway carries traffic in a single direction of traffic flow with each adjacent endless loop carrying traffic in the opposite direction to the first endless loop of traffic. A basic "building block" of the overall network comprises two endless loops and an interconnecting roadway. The innermost endless loop is fully surrounded by and bounded by the adjacent endless loop and has traffic flow in the opposite direction as the innermost endless loop. The endless loops are configured so that they have no common points of vehicle intersection so that all vehicle crossovers are eliminated and, further, there is no need for traffic to first come to a stop to allow for vehicles coming across their direction of flow to pass, as is currently required in urban intersections. Road connections between the endless loops provide traffic with the ability to freely transfer from one loop to another loop without intersecting traffic on the other loop. This is done by providing at least one loop interconnecting means. The loop interconnecting means comprises a single roadway having two-way direction flow of traffic or two one-way roadways connecting traffic flow from one loop to a second loop and second loop to the first loop also without intersections. The direction of flow of traffic on the loop interconnect is such that traffic flowing from one loop to another loop will easily merge into the flow of traffic of the loop and is in conformance with the directional pattern established for the principal one way loops. Thus, again, there are no vehicle intersections, crossovers or vehicle stoppages. This, then, is the basic "building block" for an entire network of traffic roadways.

In an alternate embodiment of the present invention, in addition to a required loop interconnecting roadway having two-way direction flow of traffic thereon, additional loop roadway interconnects can be provided so that more than one two-way roadway can serve to interconnect traffic and allow transfer of vehicles from one loop to an adjacent loop.

In another alternate embodiment of the present invention, a two-way intraloop interconnect roadway can be provided, as a quick bypass on an individual loop, so that a vehicle can travel from a first portion of a loop to a second portion of the same loop, without unnecessarily traveling around the entirety of the loop.

According to another embodiment of the present invention, multiple additional loops of one-way traffic flow are provided with each adjacent loop surrounding its interiorly contained adjacent loop and, again, having no common points of intersection. All adjacent endless loops are interconnected for transfer of traffic from one loop to the adjacent loop by at least one loop interconnect roadway having two-way direction of traffic flow.

According to another embodiment of the present invention, self-contained "building blocks" consisting of two or more endless loops having one-way traffic flow being interconnected with one another by loop interconnect roadways having two way traffic flow are, themselves, interconnected with two-way roadway interconnecting roadways to provide an overall traffic network. In this manner, an entire geographic region can be covered by the roadway system without the necessity of building new or additional roadway but, rather, by using existing roadways and merely directing traffic flow in the appropriate directions.

DETAILED DESCRIPTION OF THE DRAWINGS

Figure 1:
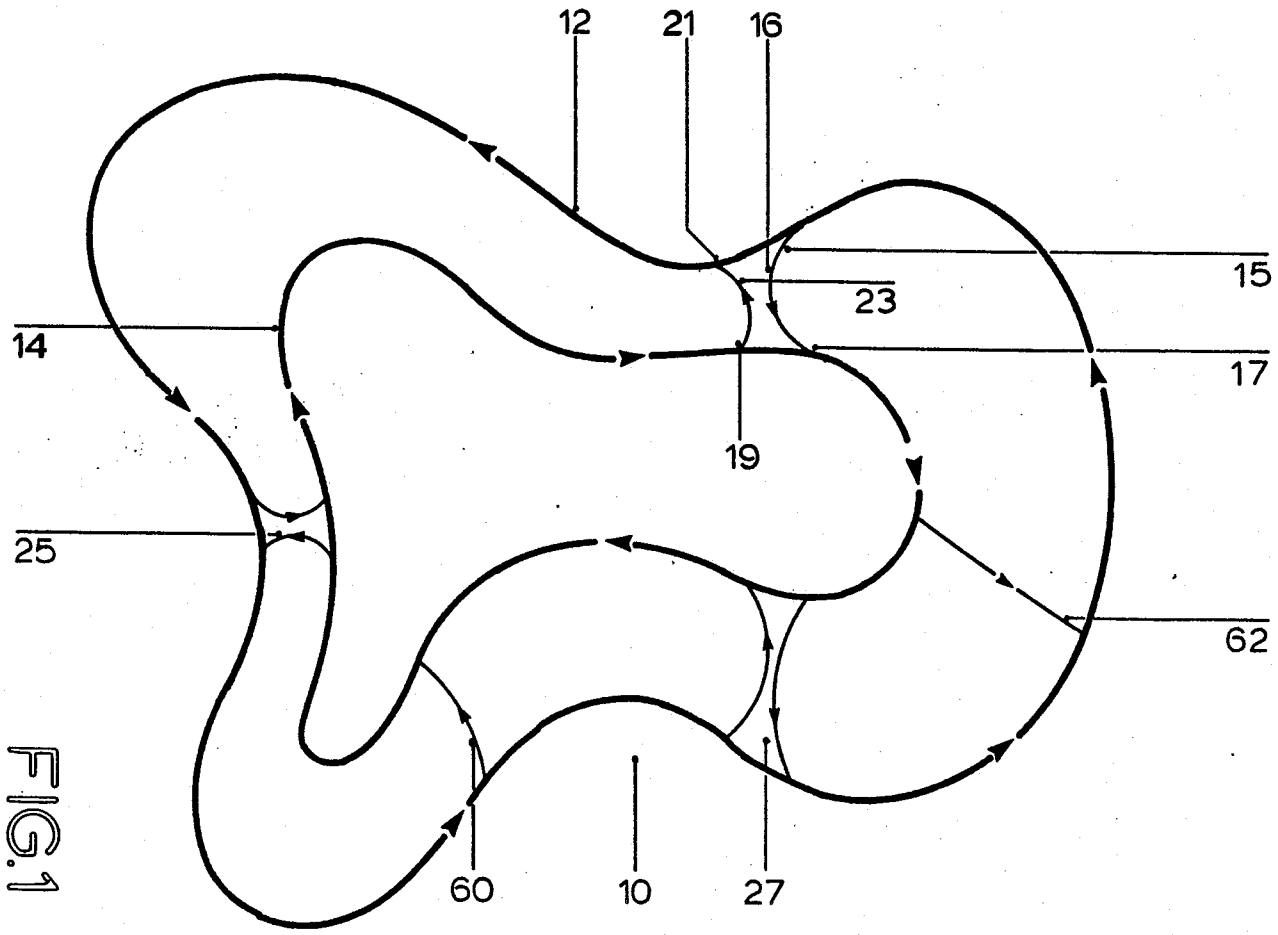
FIG. 1 is a schematic representation of the road traffic system of the present invention, in its most basic form.

FIG. 1 shows the basic "building block"10 of the present invention. It comprises an endless loop of roadway having one-way traffic flow 12. This loop of traffic flow 12 is, preferably, provided with signs serving to indicate to the drivers of vehicles on the system the proper direction of traffic flow on the endless loop. Indeed, all endless loops and interconnecting roadways, described herein, should be provided with appropriate traffic directing signs. As seen in FIG. 1, the one-way direction of traffic flow on endless loop of roadway 12 is in the relative counter clockwise direction. It will be appreciated that endless loop 12 can take a variety of shape configurations as, for example, the endless loop can be rectangular, square, circular, oval, etc. Irrespective of shape, however, it is important that the loop of roadway be endless and carry traffic in a first one-way direction of travel.

A second endless loop of roadway 14 is provided. It, too, has suitable roadway and traffic directing signs. This second endless loop 14 directs travel in a second one-way direction. The second loop 14 directs traffic in the opposite direction to the direction of traffic flowing on the first endless loop 12. According to the embodiment of the invention shown in FIG. 1, the traffic flow of direction on second endless loop 14 is thus, relatively clockwise. The second endless loop 14 can also take a variety of shape configurations and those configurations need not necessarily match the configuration of the shape of first endless loop 12 although it is contemplated in one embodiment of the present invention that the shapes of the first endless loop and the second endless loop be similar as, for example, circles or rectangles. However, the present invention is not necessarily limited to those instances where the shape of configuration of the first endless loop corresponds to the shape of configuration of the second endless loop.

The first endless loop 12 fully surrounds and contains within its borders the second endless loop 14. Thus, as can be seen in FIG. 1, there is no crossing over of traffic, traveling on first endless loop of roadway, by traffic traveling on second endless loop of roadway, or vice versa. There are no intersections of traffic and no need for stop signs or traffic lights.

Serving to interconnect vehicle traffic and to allow ease of traffic to change between the first endless loop 12 and the second endless loop 14 is a single two-way roadway 16. Roadway 16 provides two-way direction of traffic flow. Roadway 16 serves to allow traffic first flowing on endless loop 12 to transfer onto and easily merge into the traffic flow on endless loop 14, without crossing over any traffic flowing on either of the two loops and, in addition, the traffic flowing on endless loop 14 can transfer into the traffic flowing on endless loop 12, also without crossing over or intersecting any of the traffic flowing on the two loops. The roadway 16 serving to interconnect traffic between the two loops of traffic 12, 14 can, in the preferred embodiment of the present invention, be a simple two lane roadway having a traffic barrier or divider or, alternatively, two physically separate and distanced roadways or streets 60 and 62 can be provided. In either case, the loop interconnecting roadway 16 must allow traffic to flow between loops such that vehicle traffic can easily transfer from either of the two loops to the other without intersecting or crossing over traffic flowing on either of the loops.

The direction of traffic flow on each side of the roadway 16 or 60 and 62; if separate loop interconnecting roadways are used, is such that the traffic first flowing on the first loop 12, will, for example, take a left-side exit off of loop 12, onto the interconnect roadway portion 15 connecting traffic from loop 12 onto loop 14 and when transferring onto endless loop 14, as at 17, a simple left-side merge is performed, quite similar to merging on current highways. Similarly, the transfer of traffic flow from endless loop 14 onto endless loop 12 is such that a left-side exit 19 for entering onto the interconnect roadway portion 23 is provided for leaving endless loop 14 and then traffic is easily flowed onto the endless loop 12 by a similar left-hand merge as at 21. It should be appreciated, in considering the present invention, that the direction of traffic flow for the interconnect roadway portions 15 and 23 is such as to avoid intersecting and crossing over of traffic when the traffic is transferring between the endless loops. The direction of interconnecting roadway portions 15 and 23 are dictated by direction of traffic flow on the endless loops. Thus, selecting a first direction of traffic flow on one of the endless loops, predetermined the direction of traffic flow on the other endless loop (they are opposite to one another) and that, in turn, predetermines the direction of traffic flow on both portions of the loop interconnecting roadway 16.

In the preferred embodiment of the present invention, a multiple of two-way loop interconnect roadways can be provided serving to connect, at a plurality of locations, the traffic flow from the first loop 12 to the second loop 14. Thus, a vehicle traveling on the first loop and desiring to transfer to the second loop 14, does not have to go entirely around the endless loop 12 to reach interconnecting roadway 16, but, rather, the vehicle can take alternate interconnecting roadways 25 and 27. Thus, additional loop interconnect roadways 25 and 27 are provided between endless loops 12 and 14.

Figure 2:
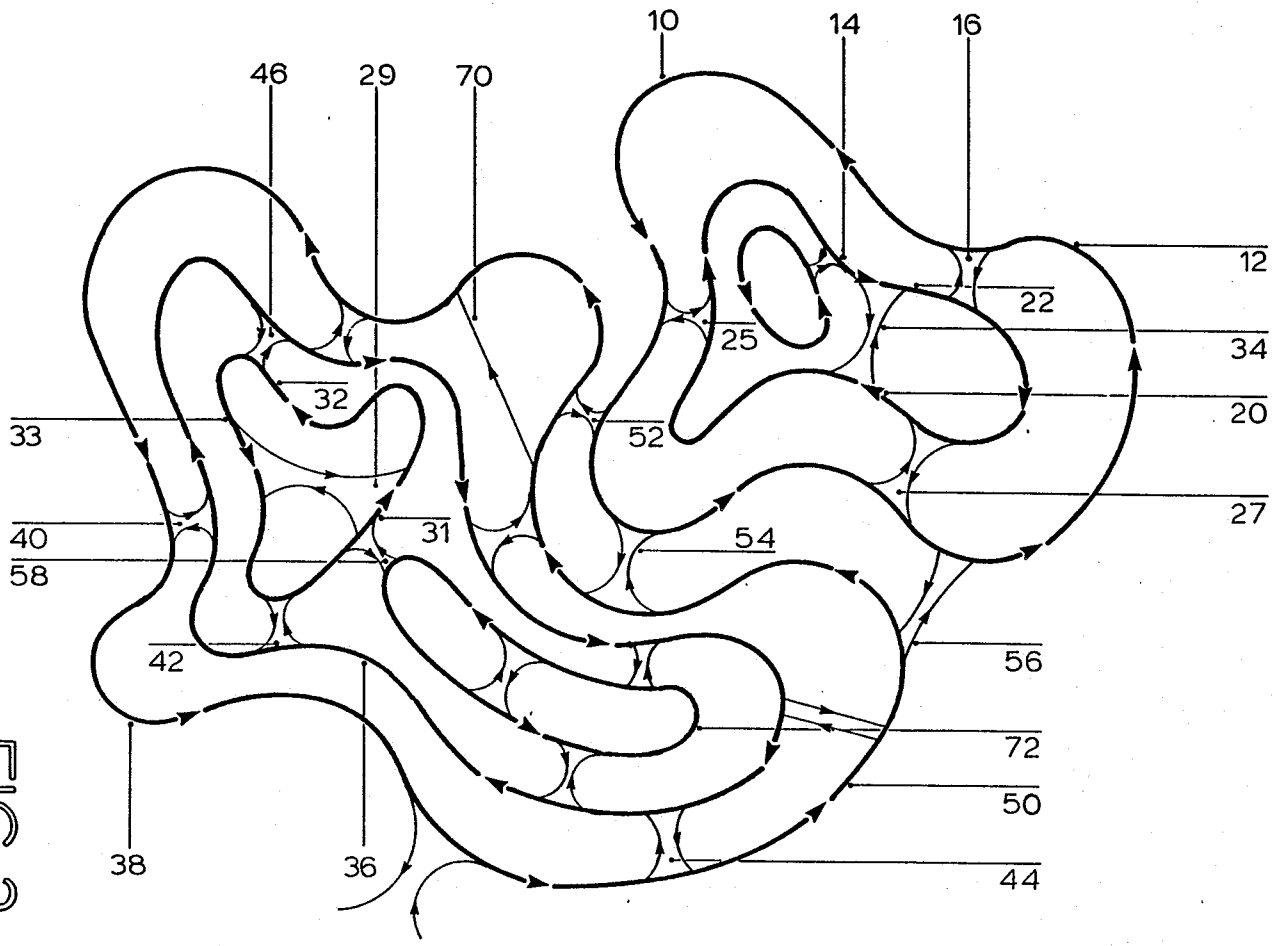
FIG. 2 is a schematic representation of a road traffic network embodying the present invention with the road traffic system of FIG. 1 used as the basic "building block" of a larger network and its relationship to a plurality of similar networks that are both internal and external to the basic system configured in FIG. 1.

FIG. 2 shows a traffic network being comprised of a plurality of basic traffic systems or "building blocks" as schematically shown in FIG. 1. Each "building block" consists of the basic unit of the present invention as shown in FIG. 1, at least the endless loops of traffic flow in opposite directions and roadways interconnecting the loops having two-way traffic flow. In addition, other aspects of the present invention are also shown in FIG. 2. For example, a bypass or shortcut roadway 29 can also be employed for intraloop traffic flow serving to allow traffic to flow from a first portion 31 of an endless loop 32 to a second portion 33 of the same endless loop 32 and vice versa. In this manner, it allows a driver in a vehicle on a loop 32 traveling in a first direction to "short-cut" the endless loop traffic, i.e., to get to the desired location without traveling along the entirety of the endless loop. Intraloop interconnecting roadway 34 is shown with respect to endless loop 14 and serves to connect first portion 20 of endless loop 14 with second portion 22 of the same endless loop 14. Here, too, the intraloop traffic interconnect means 29 and 34 are preferably, two-way directional and allow a vehicle traveling on the endless loop 14 to quickly go from a first portion of the endless loop to a second portion of the same endless loop. A single one-way directional by-pass could, of course, also be provided, as illustrated at 70.

In order to fully cover the topography of a particular geographic area and provide vehicle access to most surface area, additional endless loops 36 and 38 of traffic flow are provided with each additional endless loop completely surrounding or being surrounded by an adjacent endless loop of traffic flow (See FIG. 2). Again, it is important that the additional endless loops 36 and 38 not intersect one another nor the other endless loop 32, nor provide for vehicle crossover. Each endless loop of traffic flow 32, 36 and 38 provides one-way direction of vehicle traffic in a direction opposite to the direction of traffic flow provided by the next adjacent endless loop. Thus, with traffic flow in endless loop 32 being relatively counterclockwise, traffic flow in endless loop 36 is clockwise and adjacent endless loop 38 is again counterclockwise. Again, intraloop roadways 29, 34 and 70 can be provided for each endless loop 36 and 38 and, in addition, of necessity, each additional endless loop 36 and 38 interconnects with each adjacent endless loop 32, 36 and 38 by single two-way interconnecting roadways 40 and 42 or separate one-way roadway 60 and 62 (See FIG. 2). Again, of course, more than one interconnecting two-way roadways as, for example, 44 and 46 can be provided between each endless loop of roadway and adjacent loops of roadway, if desired. Systems of roadway or complete traffic roadway "building blocks" 10 and 50 can be interconnected by system interconnecting roadways 52, 54 and 56. Also, individual loops 32 and 72 can be interconnected by single loop interconnects 58, having two-way traffic flow or a single roadway or, alternatively, two separate one-way traffic flow roadways can be provided.

Thus, as can be best seen in FIG. 2, an entire geographic area can be provided with endless loops 12, 14, 32, 36, 38, etc. of vehicular traffic with roadway interconnecting means 16, 25, 27, 40, 42, 44, 46, etc. for allowing vehicles to transfer from first endless loops to second adjacent endless loops without any single vehicle crossing over or intersecting with any other vehicle. In this manner, traffic flow is constantly maintained and grid-lock is avoided. Left-hand turns across oncoming traffic is avoided and, in addition, stop signs and traffic lights are eliminated since traffic need not cross over in front of traffic on adjacent conventionally, perpendicularly directed streets.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

WHAT I CLAIM IS:

1. A road traffic system comprising:

(a) a first endless loop of roadway, directing traffic flow in a first one-way direction;

(b) a second endless loop of roadway, directing traffic flow in a second one-way direction opposite the said first one-way direction, said second endless loop of roadway being surrounded by said first endless loop of roadway and having no points of loop roadway intersection; and (c) at least one traffic loop interconnecting roadway means having two roadway portions in one-way opposite directions extending between said first endless loop of roadway and said second endless loop of roadway, said interconnecting roadway means allowing traffic to transfer between said first and second endless loops without crossing over or intersecting traffic traveling on said road traffic system.

2. A road traffic system as claimed in claim 1 wherein said first and said second endless loops are of similar shape configuration.

3. A road traffic system as claimed in claim 1, wherein said traffic loop interconnecting roadway means is a single roadway having two-way traffic flow.

4. A road traffic system as claimed in claim 1, wherein said traffic loop interconnecting roadway means comprise two separate roadways, one of said roadways having one-way traffic flow from said first endless loop to said second endless loop and the other of said roadways having one-way traffic from said second endless loop to said first endless loop.

5. A road traffic network comprising at least two road traffic systems as claimed in claim 1, said systems being interconnected by a systems interconnecting roadway comprising two one-way direction of traffic roadways allowing traffic to transfer between said first endless loops of roadway of said systems without crossing over or intersecting traffic on said road traffic network.

6. A road traffic network as claimed in claim 5, wherein said two one-way direction of traffic roadways are a single roadway.

7. A road traffic network as claimed in claim 5 wherein said two one-way direction of traffic roadways are physically separate.

8. A road traffic system as claimed in claim 1 and further comprising additional endless loops of roadway each of said additional endless loops of roadway surrounding an adjacent endless loop of roadway and having no points of loop roadway intersection, each of said additional endless loops of roadway directing traffic flow in a direction opposite to the direction of traffic flow in said adjacent endless loops of roadway and additional traffic loop interconnecting roadway means having a two-way direction of traffic flow extending between said additional endless loops of roadway and said adjacent endless loops of roadway, said additional traffic loop interconnecting roadway means allowing traffic to transfer between said additional endless loops of roadway and said adjacent loops of roadway without crossing over or intersecting the traffic of said road traffic system.

9. A road traffic system as claimed in claim 1, wherein at least one of said first or said second endless loops of roadway are provided with intra-loop traffic connecting means allowing traffic to transfer between a first portion of either said first or said second endless loops and a second portion of said same endless loop without traveling along the entirety of said endless loop between said first portion and said second portion and said traffic not crossing over or intersecting the traffic of said first or said second endless loop.

10. A road traffic system as claimed in claim 9 wherein said intra-loop traffic connecting means is a two-way direction of traffic roadway.

11. A method of directing traffic flow to permit continuous travel between any two points in a traffic system and without intersecting other traffic traveling in said system comprising the steps of:

(a) directing traffic flow in a first one-way direction through a first endless loop of roadway;

(b) directing traffic flow in a second one-way direction, opposite said first one-way direction, through a second endless loop of roadway which is surrounded by and does not intersect said first endless loop of roadway; and (c) directing traffic flow between said first and second endless loops of roadway through two traffic loop interconnecting roadways, the first of said traffic loop interconnecting roadways having one-way traffic flow from said first endless loop of roadway to said second endless loop of roadway and the second of said traffic loop interconnecting roadways having one-way traffic flow from said second endless loop of roadway to said first endless loop of roadway.

12. A method as claimed in claim 11, wherein said step (c) directs traffic on a single traffic-divided roadway.

13. A method as claimed in claim 11, further comprising the step of directing traffic onto a bypass roadway connecting first portion of said first or said second endless loop of roadway to a second portion of said same first or second endless loop of roadway without requiring the traffic to travel the entirety of said first or second loop of roadway in order to travel from said first portion to said second portion.

14. A method as claimed in claim 11, further comprising the step of directing traffic flow in additional one-way directed endless loops of roadway with the direction of traffic flow in each additional endless loops of roadway being opposite in direction to each adjacent endless loop of roadway.

15. A method as claimed in claim 11, further comprising the steps of providing additional traffic loop interconnecting roadways and directing traffic thereon.

16. A method of directing traffic flow comprising the steps of:

(i) providing at least two road traffic systems as claimed in claim 1; and (ii) directing traffic flow between said first endless loops of roadway by a two-way traffic directed, system interconnecting roadway; said system interconnecting roadway having a first one-way roadway having traffic flow from a first endless loop of roadway of said first traffic system to the first endless loop of roadway of said second traffic system and a second one-way roadway having traffic flow from said first endless loop of roadway of said second traffic system to the first endless loop of roadway of said first traffic system.

17. A road traffic system comprising:

(a) a first endless loop of roadway, directing traffic flow in a first one-way direction;

(b) a second endless loop of roadway, directing traffic flow in a second one-way direction opposite the said first one-way direction, said second endless loop of roadway being surrounded by said first endless loop of roadway in substantially non-contiguous, spaced-apart relation and having no points of loop roadway intersection; and (c) at least one traffic loop interconnecting roadway means having two roadway portions in one-way opposite directions extending between said first endless loop of roadway and said second endless loop of roadway, said interconnecting roadway means allowing traffic to transfer between said first and second endless loops without crossing over or intersecting traffic traveling on said road traffic system.

18. A road traffic system comprising:

(a) a first endless loop of roadway, directing traffic flow in a first one-way direction;

(b) a second endless loop of roadway, directing traffic flow in a second one-way direction, said second endless loop of roadway being surrounded by said first endless loop of roadway and having no points of loop roadway intersection; and (c) at least one traffic loop interconnecting roadway means having two roadway portions in one-way opposite directions extending between substantially spaced apart portions of said first endless loop of roadway and said second endless loop of roadway, respectively, said interconnecting roadway means allowing traffic to transfer between said spaced apart portions of said first and second endless loops without crossing over or intersecting traffic traveling on said road traffic system.

19. A road traffic system as claimed in claim 1 and further comprising one or more additional endless loops of roadway, each of said additional endless loops of roadway surrounding an adjacent endless loop of roadway in substantially non contiguous, spaced apart relation and having no points of loop roadway intersection, each of said additional endless loops of roadway directing traffic flow in a direction opposite to the direction of traffic flow in the said adjacent endless loops of roadway and additional traffic loop interconnecting roadway means having a two-way direction of traffic flow extending between spaced apart portions of said additional endless loops of roadway and said adjacent endless loops of roadway, said additional traffic loop interconnecting roadway means allowing traffic to transfer between said additional endless loops of roadway and said adjacent loops of roadway without crossing over or intersecting the traffic of said road traffic system.

20. A method of directing traffic flow to permit continuous travel between any two points in a traffic system and without intersecting other traffic traveling in said system comprising the steps of:

(a) directing traffic flow in a first one-way direction through a first endless loop of roadway;

(b) directing traffic flow in a second one-way direction, opposite said first one-way direction through a second endless loop of roadway which is surrounded in substantially non-contiguous spaced apart relation by said first endless loop of roadway; and (c) allowing traffic to flow between said first and second endless loops of roadway through two traffic loop interconnecting roadways, the first of said traffic loop interconnecting roadways having one-way traffic flow from said first endless loop of roadway to said second endless loop of roadway and the second of said traffic loop interconnecting roadways having one-way traffic flow from said second endless loop of roadway to said first endless loop of roadway.

* * * * *